US005165784A

United States Patent [19]

Loth et al.

[11] Patent Number: 5,165,784

[45] Date of Patent: Nov. 24, 1992

[54] ADJUSTABLE PHOTOGRAPHY LIGHT THAT MAINTAINS CONSTANT COLOR TEMPERATURE

[75] Inventors: Stanislaw Loth, Nanuet, N.Y.; Volker W. Bahnemann, Greenwich, Conn.

[73] Assignee: Arriflex Corporation, Bauvelt, N.Y.

[21] Appl. No.: 730,280

[22] Filed: Jul. 15, 1991

[51] Int. Cl.[5] ..... F21V 1/16

[52] U.S. Cl. ..... 362/255; 362/298; 362/351

[58] Field of Search ..... 362/255, 812, 285, 287, 362/269, 16, 18, 296, 341, 351, 311, 298, 301; 313/113, 116, 117

[56] References Cited

U.S. PATENT DOCUMENTS

| | | | |
|---|---|---|---|
| 1,208,487 | 12/1916 | Cochran | 362/255 |
| 2,088,544 | 7/1937 | Braselton | 362/255 |
| 2,163,272 | 6/1939 | Deschere | 362/255 |
| 3,281,620 | 10/1966 | Miller | 313/51 |
| 3,648,235 | 3/1972 | Cahill | 362/812 |
| 3,731,133 | 5/1973 | McRae et al. | 362/341 |
| 3,905,017 | 9/1975 | Samra | 362/812 |
| 4,186,431 | 1/1980 | Engel et al. | 362/255 |
| 4,727,457 | 2/1988 | Thillays | 362/800 |
| 4,914,435 | 4/1990 | Gould et al. | 362/812 |
| 4,989,126 | 1/1991 | Preuss | 362/812 |

*Primary Examiner*—Richard R. Cole

*Attorney, Agent, or Firm*—Anderson Kill Olick & Oshinsky

[57] ABSTRACT

An adjustable photography light including a light bulb having a ceramic layer coated over 180° of its surface, which ceramic has the same expansion coefficient as the light bulb, and which acts alternatively as a white reflector or as a mask as the bulb is rotated.

7 Claims, 2 Drawing Sheets

ADJUSTABLE PHOTOGRAPHY LIGHT THAT MAINTAINS CONSTANT COLOR TEMPERATURE

BACKGROUND OF THE INVENTION

The present invention relates to adjustable film, video and still photography lights. Existing lights of this type which have adjustable light intensity and constant color temperature are constructed with a mechanical shutter placed either in front of the light source, where the shutter controls direct light, or behind the light source where reflected light is controlled. In both these types of constructions there is light loss in the maximum light output setting, and the light beam is not even. Also, problems with air circulation affect cooling of the light. These prior art types of constructions are illustrated in FIGS. 1 and 2. In FIG. 2, the shutter is made up of vanes which are half white (W) and half black (B).

SUMMARY OF THE INVENTION

Accordingly, it is an object of the present invention to overcome the light loss at maximum light-output setting, the unevenness of the light beam, and the problems of poor air circulation which are present in the prior art devices.

Pursuant to this object, and others which will become apparent hereafter, one aspect of the present invention resides in an adjustable photography light which includes a light bulb which has a longitudinal axis, and has a ceramic layer coated over 180° of its surface relative to the longitudinal axis. The ceramic layer has the same expansion coefficient as the light bulb. The light bulb can be either a cylindrical bulb or a spherical bulb. In either case the bulb is mounted so as to be rotatable through 180° about its longitudinal axis.

In a further embodiment of the invention, a flat mirror reflector is provided to surround the bulb. This reflector can take on a variety of constructions depending upon the type of lighting effect desired, for example, softer or more uniform lighting.

These constructions provide a very simple adjustable photography light which can be adjusted to provide various levels of light output while maintaining a constant color temperature.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

DETAILED DESCRIPTION OF THE PREFERRED EMBODIMENTS

Figure 5:
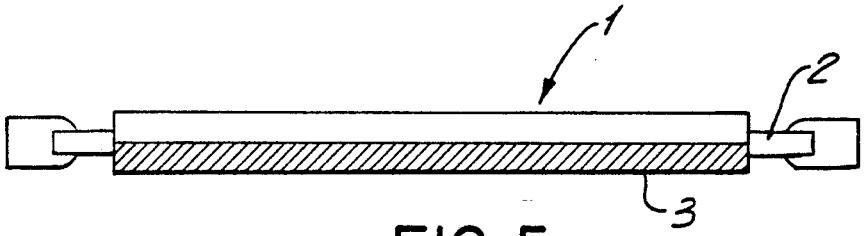
FIG. 5 is a longitudinal view of the bulb of the inventive light.

As shown in FIG. 5, the inventive light includes a bulb (1) which has a longitudinal axis X, and sockets (2) for connecting the bulb to an electrical source so that it is rotatable. A ceramic layer (3) is coated on the surface of the bulb 180° about the longitudinal axis X.

The ceramic coating (3) and the bulb (1) have the same expansion coefficient in order to avoid cracking of the ceramic coating (3) as the bulb heats and cools.

Figure 1:
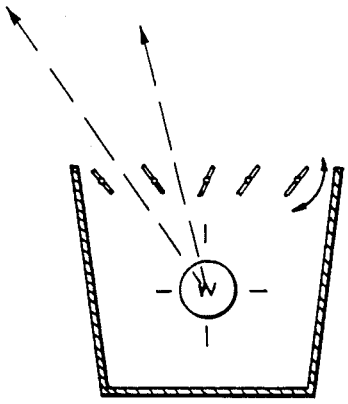
PRIOR ART FIG. 1
FIG. 1 shows an adjustable photography light known in the prior art.
Figure 2:
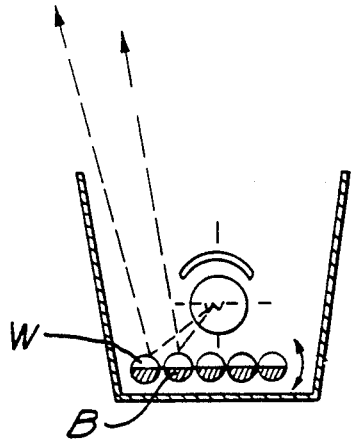
PRIOR ART FIG. 2
FIG. 2 shows another type of prior art adjustable light.
Figure 3:
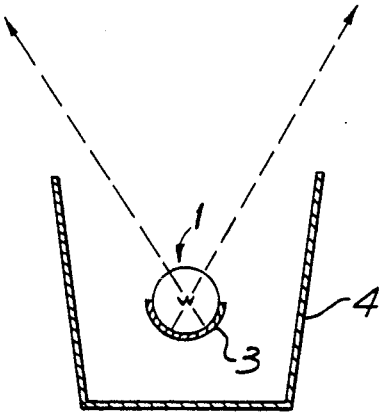
FIG. 3 shows a cross-sectional view of a first embodiment of an adjustable light pursuant to the present invention in a maximum light output setting.
Figure 4:
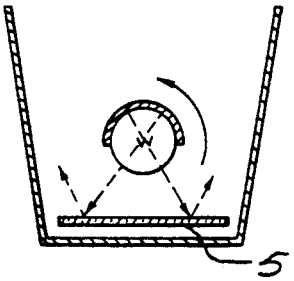
FIG. 4 is a view similar to FIG. 3 of a second embodiment of the invention in a maximum light output setting.

The rotatable sockets (2) allow the bulb (1) to be turned through 180° about its X axis. In a position of maximum light output, the ceramic layer (3) acts as a reflector placed directly upon the bulb surface. As the bulb is rotated, the same layer works as a shutter and blocks direct light emitted toward the front. This concept is illustrated in FIGS. 3 and 4.

In order to facilitate handling of the light, a housing (4) can be provided around the bulb and a black screen (5) can be located behind the bulb to absorb the light from the bulb when the bulb is rotated into a position in which it acts as a shutter.

Figure 6:
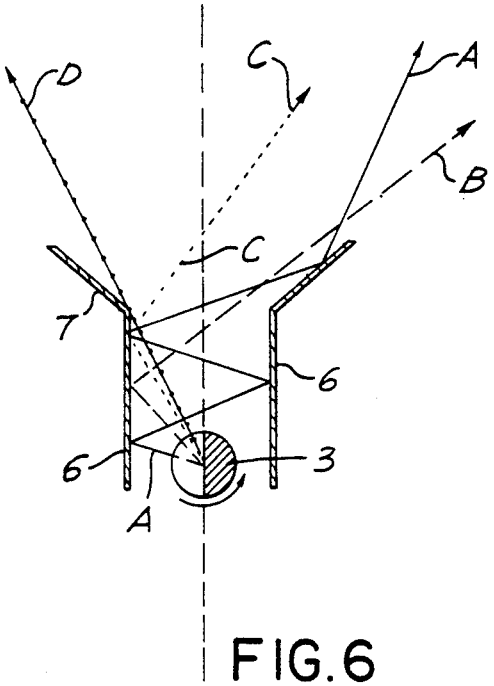
FIG. 6 illustrates an embodiment of the invention in which the bulb is surrounded by a set of flat mirror reflectors.

The bulb (1) is also surrounded by a flat-mirror reflector system which eliminates the shadow line of the bulb coating and permits the output of an even light. The flat-mirror reflector system can include two parallel main reflectors (6) and a front reflector (7) connected to a foremost end (relative to the outlet end of the light) of each main reflector (6). The front reflector (7) diverging from the main reflector (6). This embodiment is illustrated in FIG. 6, which Figure shows the light beams at a 50% light output position of the bulb. As can be seen from this Figure, light beams A, B and C are reflected light which replace those beams shadowed by the bulbs ceramic layer (3), and D is direct light beam. The multiple reflection thus provides an even illumination as the bulb is rotated from maximum to minimum light output.

Figure 7:
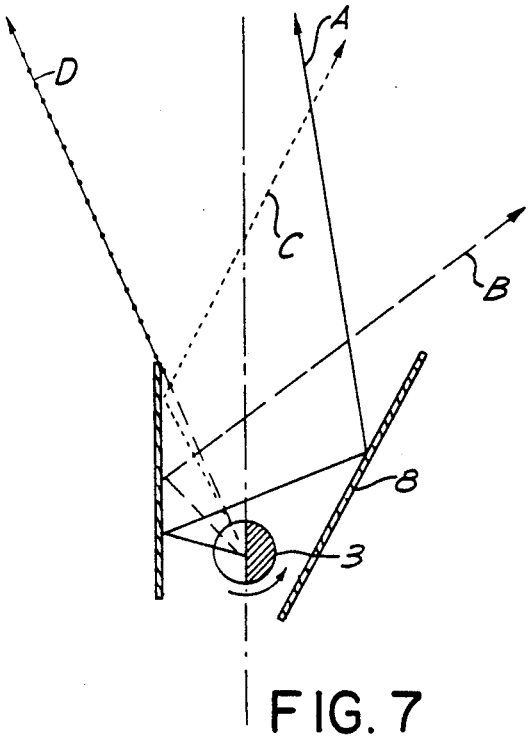
FIG. 7 illustrates still a further embodiment of the invention.

FIG. 7 illustrates still another embodiment of the invention in which two diverging mirrors (8) are used as the reflector system. Once again, the reflected light beams are indicated with A, B and C, while D is a direct light beam.

The above-described embodiments are well suited for the use in so-called soft lights where the light is additionally reflected from a soft reflector surface, which leads to a controlled even light output across the entire beam angle.

Figure 9:
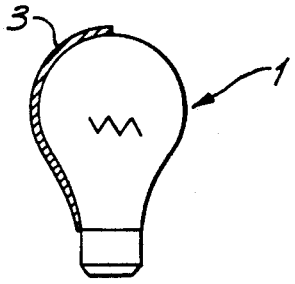
FIG. 9 illustrates the invention with a spherical bulb.

It is also possible to replace the longitudinal bulb with a spherical bulb which is mounted at only one end to a socket, and coating the surface of the spherical bulb over 180° with a ceramic layer, as with the previously discussed cylindrical bulb, this is illustrated in FIG. 9.

Figure 8:
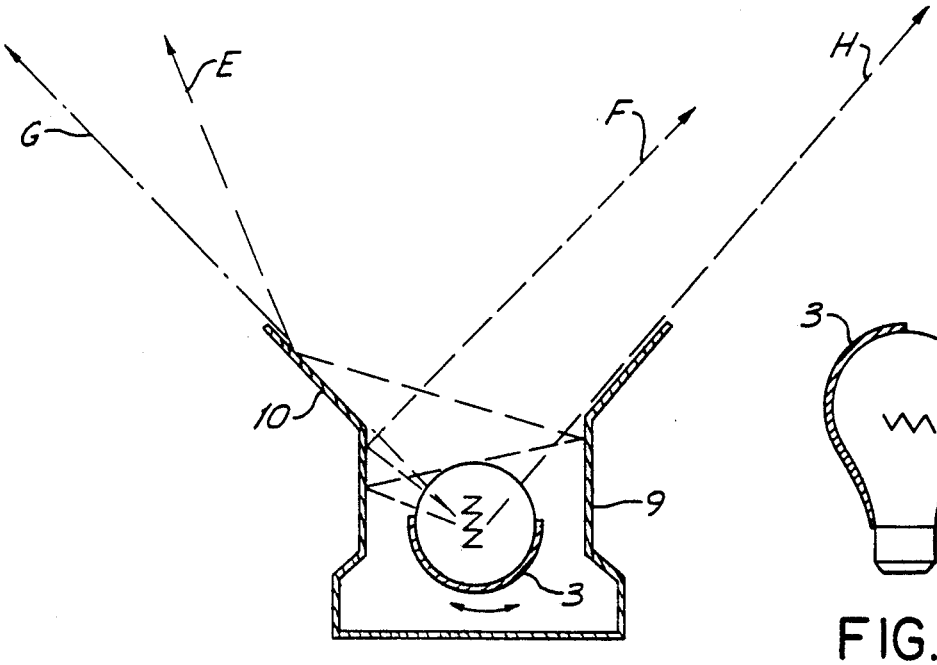
FIG. 8 illustrates yet another embodiment of the invention.

FIG. 8 illustrates an embodiment in which the ceramic layer (3) replaces a rear reflector of an adjustable light arrangement with a spherical bulb. In this embodiment, (9) is the main reflector and (10) is the front reflector, which are arranged relative to one another similarly to the embodiment of FIG. 6. The light beams E, F, G and H of this construction represent both direct and reflected light.

While the invention has been illustrated and described as embodied in an adjustable photography light, it is not intended to be limited to the details shown, since various modifications and structural changes may be made without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitute essential characteristics of the generic or specific aspects of this invention.

What is claimed as new and desired to be protected by letters patent is set forth in the appended claims.

1. An adjustable photography light, comprising;

a light bulb having a longitudinal axis and an expansion coefficient;

means for mounting the bulb so that it is rotatable about its longitudinal axis; and a ceramic layer coated on the bulb 180° about the longitudinal axis so that one-half of the bulb is coated and another half of the bulb is not coated, said ceramic layer having an expansion coefficient equal to that of the light bulb.

2. An adjustable photography light according to claim 1, wherein the light bulb is spherical and the means for mounting the bulb is arranged at only one end of the bulb on the longitudinal axis.

3. An adjustable photography light according to claim 1, wherein the light bulb is cylindrical and has two opposite ends along the longitudinal axis, the means for mounting the bulb being provided at the two opposite ends.

4. An adjustable photography light according to claim 1, and further comprising multi-mirror reflector means surrounding the bulb.

5. An adjustable photography light according to claim 4, wherein the reflector means includes two main reflectors arranged on either side of the bulbs so as to diverge from one another in a light output direction.

6. An adjustable photography light, comprising:

a light bulb having a longitudinal axis and an expansion coefficient;

means for mounting the bulb so that it is rotatable about its longitudinal axis;

a ceramic layer coated on the bulb 180° about the longitudinal axis so that one-half of the bulb is coated and another half of the bulb is not coated, said ceramic layer having an expansion coefficient equal to that of the light bulb; and mirror reflector means surrounding the bulb.

7. An adjustable photography light, comprising:

a light bulb having a longitudinal axis and an expansion coefficient;

means for mounting the bulb so that it is rotatable about its longitudinal axis;

a ceramic layer coated on the bulb 180° about the longitudinal axis, said ceramic layer having an expansion coefficient equal to that of the light bulb; and multi-mirror reflector means surrounding the bulb, said reflector means including two parallel main reflectors on opposite sides of the bulb and front reflector connected to each parallel main reflector so as to diverge from one another.

* * * * *